United States Patent [19]

de la Burde et al.

[11] Patent Number: 4,459,100

[45] Date of Patent: Jul. 10, 1984

[54] PROCESS FOR EXPANSION OF TOBACCO

[75] Inventors: Roger Z. de la Burde, Powhaton; Francis V. Utsch, Midlothian; Patrick E. Aument, Richmond, all of Va.

[73] Assignee: Philip Morris Incorporated, New York, N.Y.

[21] Appl. No.: 315,449

[22] Filed: Oct. 27, 1981

Related U.S. Application Data

[63] Continuation-in-part of Ser. No. 145,824, May 1, 1980, abandoned.

[51] Int. Cl.[3] ..... A24F 3/18

[52] U.S. Cl. ..... 131/296

[58] Field of Search ..... 131/296, 292, 291, 294, 131/295

[56] References Cited

U.S. PATENT DOCUMENTS 4,366,825 1/1983 Utsch et al. ..... 131/296

FOREIGN PATENT DOCUMENTS

WO83/00989 3/1983 PCT Int'l Appl. .

*Primary Examiner*—V. Millin

[57] ABSTRACT

A process is provided for expanding tobacco by means of overwetting the tobacco to a moisture content of at least 20%, preferably from 20% to about 80%, and then overdrying the tobacco in a period of a few seconds in a turbulent steam atmosphere to a moisture content of less than 7% to achieve increased filling power. The overwetted tobacco is preferably dried to a moisture content of less than 7% within a time period of less than 5 seconds. It is preferred that the tobacco be dried to a moisture content of less than 5%, and even more preferred that it be dried to a moisture content of less than 3%. The turbulent steam drying atmosphere preferably comprises at least about 60% steam. Typically, the tobacco is bulked for from about ¼ hour to 4 hours after it is overwetted to allow the moisture to be distributed within and absorbed by the tobacco cellular structure of substantial portions of the tobacco. Subsequent to overdrying, the tobacco is typically remoisturized to a processing moisture content of about 12%.

10 Claims, No Drawings

PROCESS FOR EXPANSION OF TOBACCO

This application is a continuation-in-part of application Ser. No. 145,824, filed May 1, 1980, and now abandoned.

BACKGROUND OF THE INVENTION

The present invention relates to a process for increasing the filling power of tobacco. More particularly, the present invention relates to a process for expanding tobacco which includes overwetting the tobacco with water and rapidly overdrying the overwetted tobacco in a turbulent steam atmosphere.

The heretofore known expansion processes may be broadly characterized as involving penetration or impregnation of the tobacco with a blowing or puffing agent, sometimes referred to hereinafter as an "impregnant", which when removed during a subsequent expansion step generates elevated pressure in the tobacco and and thereby causes expansion of the cell volume. The impregnant may be a solid, a liquid, or a gas.

Among the impregnants which have been employed are pressurized steam, air, water, organic solvents, ammonia, carbon dioxide, combinations of ammonia and carbon dioxide, and compounds capable of liberating a gas when subjected to chemical decomposition, as by heating. Where gases or other chemicals are utilized to cause or aid in expansion, physio-chemical changes may occur in the tobacco.

Among the means disclosed for removing the impregnant to expand the cell volume are a sudden reduction in pressure, freeze-drying, convection heating, radiant transfer, and the application of a microwave field. However, some of the aforementioned processes provide only a low level of expansion.

Processes employing water as an impregnant have tended to produce a more satisfactory result with tobacco stems than with tobacco lamina filler. It may be that the greater permeability of the leaf structure permits the water impregnant to escape before substantial expansion can take place. Removal of the water impregnant has typically been effected by such techniques as freeze-drying or exposure to a microwave field. Freeze-drying is a comparatively slow and expensive approach and may result, in some instances, in a product which has an objectionable amount of tackiness because of the hygroscopicity of a film-like layer of water-extracted solids which forms on the surface of the tobacco. The use of a microwave field requires elaborate and expensive equipment and may tend to be more effective with tobacco stems than with tobacco lamina filler.

Many of the prio art processes possess various disadvantages, most of which can be generally categorized as requiring prolonged treatment, batch processing and high energy usage. The process of the present invention offers advantages over many of these prior art processes and does not require foreign agents or chemical additives to achieve the objective of significantly increased filling power by expansion of the tobacco, which may be cut filler or the like.

DEFINITIONS

Oven Volatiles (OV)

As used herein, oven volatiles is the percent weight loss of tobacco in a circulating air oven in three hours at 100° C. OV is used herein to mean the "moisture content" of the tobacco.

Filling Power

As used herein, filling power is the ability of the material to provide a firm rod. The filling power is the minimum weight of tobacco which will produce a tobacco rod of specified dimensions and firmness and may be measured as the volume occupied by a specified weight of filler in an upright cylinder when a specified piston weight is applied to its top surface, as set forth in "Filling Volume of Cut Tobacco and Cigarette Hardness", H. Wakeham, et al., Tobacco Science xx: 164–167, 1976. Standard equilibrium conditions for measurement of filling power are usually 60% relative humidity (RH) at 75° F. (23.9° C.).

Cylinder Volume (CV)

As used herein, cylinder volume is a measurement of filling power and is determined by placing 10.0 grams of filler in a standard metal cylinder, 3.358 cm. in diameter, and then vibrating the assembly for one-half minute to settle the tobacco column. The tobacco is then compressed under a piston weighing 1875 grams and having a diameter of 3.335 cm for five minutes and the volume reading is then taken. The standard deviation of the cylinder volume measurement is about 1.5%.

SUMMARY OF THE INVENTION

The present invention provides a process for expanding tobacco by means of overwetting the tobacco to a moisture content of at least 20% and then overdrying the tobacco in a period of a few seconds in a turbulent steam atmosphere to a moisture content below the moisture content normally encountered in processing. It has been determined that such overdrying must occur to a moisture content of less than 7% to achieve increased filling power.

DESCRIPTION OF PREFERRED EMBODIMENTS

According to the process of the present invention, tobacco lamina or cut tobacco filler is moisturized to a moisture content of at least 20% which is above the moisture level of unprocessed tobacco and appreciably above the normal 12% processing moisture level of tobacco. It has been found that when tobacco having a moisture content above 20% is treated according to the process of the present invention, significant increases in filling power are achieved. At a moisture content of 20%, expansion may also be attained by rapidly overdrying the tobacco according to the process of the present invention, but the chemical and physical properties of the tobacco will have a greater influence on the effectiveness of the process.

Preferably, the moisture content of the tobacco is from 20% to about 80%, and more preferably from about 30% to about 80%, although moisture contents within the range of 20% to about 40% are effectively employed. Moisture contents of about 60% to about 80% may be effectively employed, but penetration or bulking time will probably increase and drying the tobacco within the desired times and to the desired post-treatment moisture levels will be more expensive and time consuming.

It is desired that the moisture be allowed to substantially uniformly penetrate and be distributed or dispersed throughout the cellular structure of the tobacco being processed, although homogeneous dispersion is not required. The bulking penetration time for satisfactory penetration will depend upon batch size and upon the means of addition of the water and the desired economics. Employing a rotary cylinder and a fine mist spray or other conventional mixing system known in the art for incorporating additives, a penetration time of 4 hours or somewhat less will be sufficient, as is further illustrated in Example 5. The primary criterion is that the time of penetration be sufficient to allow the moisture to be distributed within and absorbed by the tobacco cellular structure of substantial portions of the tobacco. Typically, the overwetted tobacco is bulked from about ¼ hour to about 4 hours.

As previously stated, after penetration of the moisture throughout the tobacco structure, the tobacco is overdried in a period of a few seconds in a turbulent steam atmosphere. The term "overdrying" in the context of the present invention means drying the overwetted tobacco to a moisture content below the moisture contents typically encountered and utilized in the processing of tobacco. The normal or conventional moisture content of tobacco to be processed, particularly that of commonly used tobacco filler, is usually approximately about 12% to about 21%.

Rapid drying of the tobacco, preferably within less than 5 seconds, in a turbulent steam atmosphere to a moisture content of less than 7% expands the tobacco as the moisture rapidly escapes the tobacco cellular structure. The cellular structure of the tobacco fibers thereupon stiffen to retain the expanded nature of the tobacco during remoisturization to normal processing moisture contents. Preferably, the tobacco is dried to a moisture content of less than 5% and more preferably to a moisture content of less than 3%, with drying to a moisture content of 2% to 3% being particularly preferred. Steam drying versus air drying produces substantial gains in filling power as will be noted from Example 2.

To achieve and retain the desired expansion, it has been found that the more rapid the drying, the more effective the process. In effect, an almost immediate evaporation of the moisture is sought. Drying times of 5 seconds or less are desired to achieve a 2% to 5% moisture content, if not even a lower moisture content. The more rapid the drying step, the more rapid the evolution of the moisture and the more effective the expansion. Residence times longer than 5 seconds do not appear to produce the desired expansion levels.

To rapidly overdry the tobacco, a high turbulence drying unit such as a Proctor & Schwartz dispersion dryer, or a Jetstream® dryer or other equivalent drying tower, capable of producing a turbulent atmosphere high in steam content, may be utilized. The proportion of steam in the turbulent steam drying atmosphere is desirably at least about 60%, and preferably at least about 80% although steam contents of about 60% to about 70% can be effectively employed.

With regard to the treatment temperature, that is, the temperature of the turbulent steam atmosphere in the drying unit, at temperatures of at least about 232° C. and employing properly designed and reasonably efficient equipment which allows rapid drying of the moisturized tobacco in a period of seconds, the moisture content of the overwetted tobacco may be reduced to less than about 5% to produce economically significant increases in filling power. Rapid drying in a turbulent steam atmosphere at a treatment temperature of at least about 316° C., and preferably from about 316° C. to about 330° C. provides substantial increases in filling power. As will be seen in Example 3, treatment temperatures of about 121° C. provide little useful increase in filling power; temperatures from about 149° C. to about 204° C. provide perceptible gains in filling power; temperatures from about 232° C. to about 288° C. provide moderate increases in filling power, and temperature of from about 288° C. to about 316° C. provide significant increases in filling power. Further, in accordance with the practice of the present invention, turbulent steam atmospheres having temperatures as high as 500° C. may be successfully utilized.

Subsequent to overdrying, the tobacco is preferably remoisturized under mild conditions, by means and processes well known in the industry for reordering tobacco, such as cylinder reordering, to achieve a processing moisture content of about 12%. The reordering should be at a moderate rate to prevent loss of expanded fiber rigidity.

The following examples present illustrative but nonlimiting embodiments of the present invention. Comparative examples are also presented.

EXAMPLE 1

Five pounds of bright cut filler were placed in a small rotary cylinder and sprayed with a fine water mist until the moisture content was raised to 30% water by weight. The filler was allowed to bulk for 4 hours and was then dried in a steam atmosphere in a high turbulence drying tower at 316° C. for 4 seconds. The rapidly dried filler was allowed to equilibrate for 18 hours at 21° C. and 60% RH after which OV and CV measurements were taken and compared to an untreated control. The results are summarized below in Table 1.

TABLE 1

| | Processed Tobacco | Untreated Control |
|---|---|---|
| Tower Exit OV, % | 1.8 | — |
| Equilibrated OV, % | 11.8 | 12.3 |
| Equilibrated CV, cc/10 g (Filling Power) | 54.2 | 36.4 |
| CV, cc/10 g (corrected to 12% OV) | 52.7 | 38.7 |
| % Gain in CV | 36.2 | — |

EXAMPLE 2

Two 5-pound samples of bright cut filler were processed as in Example 1 except that Sample 2 was dried in a tower at 316° C. in the absence of steam. The results are summarized below in Table 2.

TABLE 2

| | Sample | | Untreated |
|---|---|---|---|
| | 1 | 2 | Control |
| Initial OV, % | 30 | 30 | — |
| Tower Exit OV, % | 1.7 | 1.8 | — |
| Equilibrated OV, % | 11.6 | 11.9 | 12.4 |
| Equilibrated CV cc/10 g. | 56.9 | 43.3 | 35.7 |
| CV, cc/10 g (corrected to 12% OV) | 53.9 | 42.6 | 38.6 |
| % Gain in CV | 39.3 | 10.1 | — |
| Tower Atmosphere | Steam | Air | — |

It can be seen when comparing a sample dried in a turbulent steam atmosphere with a sample dried in an air atmosphere that significant gains in filling power are achieved employing a turbulent steam atmosphere.

EXAMPLE 3

50 pounds of bright filler were moisturized and bulked as in Example 1. Samples of the overwetted filler were processed in a steam atmosphere in a high turbulence drying tower at 121° C., 149° C., 177° C., 204° C., 232° C., 260° C., 288° C., 316° C. and 330° C. in a time period of 4 seconds or less. The results are summarized in Table 3 below and illustrate the significant gains in filling power which are achieved by overdrying the overwetted tobacco at elevated temperatures in a turbulent steam atmosphere.

TABLE 3

| Sample | 1 | 2 | 3 | 4 | 5 | 6 | 7 | 8 | 9 | Untreated Control |
|---|---|---|---|---|---|---|---|---|---|---|
| Initial OV, % | 30 | 30 | 30 | 30 | 30 | 30 | 30 | 30 | 30 | |
| Tower Temperature, °C. | 121 | 149 | 177 | 204 | 232 | 260 | 288 | 316 | 330 | — |
| Tower Temperature, °F. | 250 | 300 | 350 | 400 | 450 | 500 | 550 | 600 | 625 | — |
| Tower Exit OV, % | 15.6 | 11.8 | 11.0 | 8.4 | 7.6 | 4.8 | 2.8 | 1.9 | 1.0 | — |
| Reordered CV, cc/10 g | 31.6 | 37.6 | 38.3 | 37.6 | 41.1 | 45.8 | 46.9 | 57.2 | 60.8 | 37.8 |
| Reordered OV, % | 12.8 | 12.2 | 12.1 | 12.1 | 11.9 | 11.5 | 11.5 | 11.2 | 11.0 | 12.0 |
| CV, cc/10 g (corrected to 12% OV) | 37.6 | 38.5 | 38.0 | 38.3 | 39.7 | 42.0 | 42.7 | 51.1 | 53.3 | 37.8 |
| % Gain in CV | −0.5 | 1.8 | 3.2 | 1.3 | 5.0 | 11.1 | 13.0 | 35.1 | 41.0 | — |

EXAMPLE 4

Seven 5-pound samples of bright filler were overwetted and bulked to moisture contents of 15%, 20%, 25%, 30%, 40%, 60% and 80% respectively. Each sample was then processed in a tower dryer containing a turbulent steam atmosphere and at the treatment temperature indicated in Table 4 below to less than about 1.5% OV in the indicated treatment time or less. The moisture levels of 60% and 80% required two passes through the tower to achieve the desired overdrying to a moisture level of 1.5% OV. The results of these runs are summarized below in Table 4 and indicate that the desired increases in filling power are achieved with tobacco overwetted to moisture contents in excess of 20%.

TABLE 4

| Initial Moisture, Content (OV) % | Tower Temperature, °C. | Residence Time, Seconds* | Tower Exit OV, % | CV, cc/10 g (corrected to 12% OV) | CV % Gain |
|---|---|---|---|---|---|
| 15 | 185 | 4 | 1.0 | 40.3 | 3.6 |
| 20 | 216 | 4 | 1.3 | 56.8 | 46.0 |
| 25 | 266 | 4 | 1.1 | 55.8 | 43.4 |
| 30 | 316 | 4 | 1.3 | 58.3 | 49.9 |
| 40 | 370 | 4 | 1.5 | 59.4 | 52.7 |
| 60 | 316 | 8 | 1.5 | 60.2 | 54.7 |
| 80 | 370 | 8 | 1.3 | 61.1 | 57.1 |
| Untreated Control | — | — | — | 38.9 | — |

*Residence time was, at most, the time recorded.

EXAMPLE 5

Fifty pounds of bright filler were moisturized and equilibrated as in Example 1. The filler was allowed to bulk, and portions were removed after ¼, ½, 1, 2, 3, 4 and 24 hours of bulking. The 7 sample portions were rapidly dried in a tower containing a turbulent steam atmosphere at 316° C. The results are summarized in Table 5 below.

TABLE 5

| Sample | Bulking Time (Hours) | Initial Moisture Content (OV), % | Tower Exit OV, % | CV, cc/10 g (Equilibrated at 12% OV) |
|---|---|---|---|---|
| 1 | ¼ | 30 | 2.0 | 53 |
| 2 | ½ | 30 | 2.1 | 54 |
| 3 | 1 | 30 | 2.0 | 56 |
| 4 | 2 | 30 | 2.2 | 57 |
| 5 | 3 | 30 | 1.9 | 58 |
| 6 | 4 | 30 | 1.9 | 57 |
| 7 | 24 | 30 | 2.0 | 57 |

The results indicate that bulking from 4 to 24 hours has no significant effect upon the filling power increase as compared with bulking from 174 hour to 4 hours and that bulking is not a critical consideration.

EXAMPLE 6

Fifty pounds of bright filler were processed as in Example 1. The processed filler, after reordering, had a filling power of 56 cc/10 g, corrected to 12% moisture. Cigarettes were made in which 15% of the conventional filler was replaced by the processed filler and the subjective qualities of these cigarettes were compared with those of standard production cigarettes. There were no major subjective differences and the cigarettes containing the 15% expanded tobacco were found to be equally satisfying and to have full flavor.

It will be understood that the particular embodiments of the invention described above in Examples 1 through 6 are only illustrative of the principles of the invention, and that various modifications can be made by those skilled in the art without departing from the scope and spirit of the invention.

We claim:

1. A process for the expansion of tobacco comprising:

moisturizing the tobacco with water to a moisture content within the range of from about 30% to about 80%;

bulking the moisturized tobacco at substantially ambient conditions to allow the moisture to penetrate the cellular structure of the tobacco; and rapidly drying the moisturized tobacco within 5 seconds in a turbulent steam atmosphere at a temperature of at least about 280° C. to a moisture content of less than about 5%.

2. The process of claim 1 wherein the temperature is from about 288° C. to about 316° C.

3. The process of claim 1 wherein the temperature is at least about 316° C.

4. The process of claim 2 or 3 wherein the tobacco is dried to a moisture content of less than 3%.

5. The process of claim 1, 2 or 3 wherein the turbulent steam atmosphere comprises at least about 60% steam.

6. A process for the expansion of tobacco comprising:

moisturizing the tobacco with water to a moisture content within the range of from about 30% to about 80%;

bulking the moisturized tobacco at substantially ambient conditions for from about ¼ hour to about 4 hours to allow the moisture to penetrate the cellular structure of the tobacco;

rapidly drying the moisturized tobacco within 5 seconds to a moisture content of less than 5% in a turbulent steam atmosphere at a temperature of at least about 288° C.; and reordering the dried tobacco to a moisture content within the range of from about 12% to about 21%.

7. The process of claim 6 wherein the turbulent steam atmosphere comprises at least about 60% steam and the temperature is at least about 316° C.

8. The process of claim 7 wherein the turbulent steam atmosphere comprises at least about 80% steam.

9. The process of claim 7 or 8 wherein the tobacco is dried to a moisture content of less than 3%.

10. A process for the expansion of tobacco comprising:

moisturizing the tobacco with water to a moisture content of from about 30% to about 40%;

bulking the moisturized tobacco at substantially ambient conditions to allow the moisture to penetrate the cellular structure of the tobacco; and rapidly drying the moisturized tobacco within 5 seconds to a moisture content of less than 3% in a turbulent steam atmosphere comprising at least about 60% steam at a temperature in the range of from about 316° C. to about 370° C.

* * * * *

UNITED STATES PATENT AND TRADEMARK OFFICE

CERTIFICATE OF CORRECTION

PATENT NO. : 4,459,100

DATED : July 10, 1984

INVENTOR(S) : Roger de la Burde et al

It is certified that error appears in the above-identified patent and that said Letters Patent is hereby corrected as shown below:

Column 7, line 6, change "280°C" to --288°C--.

Signed and Sealed this

*Fifteenth* Day of *January 1985*

[SEAL]

*Attest:*

GERALD J. MOSSINGHOFF

*Attesting Officer*

*Commissioner of Patents and Trademarks*